US010710144B2

(12) United States Patent
Pfender

(10) Patent No.: US 10,710,144 B2
(45) Date of Patent: Jul. 14, 2020

(54) DEVICE FOR PRODUCING REINFORCEMENTS

(71) Applicant: MBK MASCHINENBAU GMBH, Kisslegg (DE)

(72) Inventor: Albert Pfender, Kisslegg (DE)

(73) Assignee: MBK Maschinebau GmbH, Kisslegg (DE)

( * ) Notice: Subject to any disclaimer, the term of this patent is extended or adjusted under 35 U.S.C. 154(b) by 0 days.

(21) Appl. No.: 16/169,017

(22) Filed: Oct. 24, 2018

(65) Prior Publication Data

US 2019/0118243 A1 Apr. 25, 2019

Related U.S. Application Data

(63) Continuation of application No. PCT/EP2017/052896, filed on Feb. 9, 2017.

(30) Foreign Application Priority Data

May 2, 2016 (DE) ..... 10 2016 108 098

(51) Int. Cl.
*B21F 27/12* (2006.01)
*B21F 27/10* (2006.01)

(52) U.S. Cl.
CPC ..... *B21F 27/124* (2013.01); *B21F 27/10* (2013.01); *B21F 27/121* (2013.01)

(58) Field of Classification Search
CPC ..... B21F 27/00; B21F 27/005; B21F 27/02; B21F 27/04; B21F 27/12; B21F 27/121; B21F 27/122; B21F 27/124
See application file for complete search history.

(56) References Cited

U.S. PATENT DOCUMENTS 4,365,657 A * 12/1982 Pfender ..... B21F 27/124 140/112
4,625,773 A * 12/1986 Pfender ..... B21F 27/124 140/112

(Continued)

FOREIGN PATENT DOCUMENTS

DE 23 60 532 A1 6/1975
DE 25 44 318 A1 4/1976

(Continued)

OTHER PUBLICATIONS

European Office Action (Application No. 17 155 416.5) dated Aug. 22, 2017 (with English translation).

(Continued)

*Primary Examiner* — Pradeep C Battula
(74) *Attorney, Agent, or Firm* — Burr & Brown, PLLC

(57) ABSTRACT

Device for producing reinforcements, in particular reinforcement baskets for concrete pipes having a bell-shaped socket end, having an expansion device which has a single expansion slide, wherein the expansion slide is configured for modifying, in particular, during the production process of the reinforcement, a radial position of an assigned actuating element for a longitudinal wire of the reinforcement by way of a transmission mechanism of the expansion device. The device is characterized in that the expansion device has a mold slide, wherein an actuator drive is provided for moving the mold slide, and wherein the actuator drive for a linear movement of the mold slide in relation to the expansion slide is supported on the expansion slide.

16 Claims, 4 Drawing Sheets

(56) References Cited

U.S. PATENT DOCUMENTS

| | | | | | |
|---|---|---|---|---|---|
| 5,271,436 | A * | 12/1993 | Pfender | B21F 27/124 | 140/112 |
| 6,148,873 | A * | 11/2000 | Mehre | B21F 27/125 | 140/112 |
| 6,223,785 | B1 * | 5/2001 | Barden | B21F 27/124 | 140/112 |
| 2008/0257445 | A1 | 10/2008 | Subacchi | | |

FOREIGN PATENT DOCUMENTS

| | | | |
|---|---|---|---|
| DE | 29 46 297 | A1 | 5/1981 |
| EP | 1 637 250 | A1 | 3/2006 |
| WO | 2014/184787 | A1 | 11/2014 |

OTHER PUBLICATIONS

International Search Report and Written Opinion (Application No. PCT/EP2017/052896) dated Jul. 19, 2017 (with English translation).

English translation of International Preliminary Report on Patentability (Chapter I) (Application No. PCT/EP2017/052896) dated Nov. 6, 2018, 14 pages.

* cited by examiner

DEVICE FOR PRODUCING REINFORCEMENTS

CROSS REFERENCE TO RELATED APPLICATIONS

This application is a continuation of International Application No. PCT/EP2017/052896 filed Feb. 9, 2017, which designated the United States, and claims the benefit under 35 USC § 119(a)-(d) of German Application No. 10 2016 108 098.5 filed May 2, 2016, 2015, the entireties of which are incorporated herein by reference.

FIELD OF THE INVENTION

The present invention relates to a device for producing reinforcements, in particular reinforcement baskets for concrete pipes having a bell-shaped socket end, as well as to a machine for producing reinforcements using such a device.

BACKGROUND OF THE INVENTION

Devices for producing reinforcements of the type mentioned at the outset are already known.

One known device is configured as an expansion device which has a plurality of adjustment rods which in the axial direction are adjustable relative to one another, in each case one radially adjustable guide for adjusting longitudinal rods of the reinforcement being articulated on the adjustment rods. The adjustment rods in turn interact with an adjustment plate which by virtue of detents on the adjustment rod delimit an actuating path of the adjustment rods.

By way of a suitable arrangement of the detents on the adjustment rods and of an adjustment of the adjustment rods, and thus of an adjustment of longitudinal rods of a reinforcement, it is possible for a shape of the reinforcement to be changed.

SUMMARY OF THE INVENTION

The present invention is based on the object of providing an alternative device for producing reinforcements, in particular reinforcement baskets for concrete pipes having a bell-shaped socket end.

The present invention proceeds from a device for producing reinforcements, in particular reinforcement baskets for concrete pipes having a bell-shaped socket end, having an expansion device which has a single expansion slide, wherein the expansion slide is configured for modifying, in particular, during the production process of the reinforcement, a radial position of an actuating element for a longitudinal wire of the reinforcement by way of a transmission mechanism of the expansion device.

The transmission mechanism of the expansion device is embodied, for example, as a drive chain and/or as a drive rod.

The substantial aspect of the present invention now is to be seen in that the expansion device has a mold slide, wherein an actuator drive is provided for moving the mold slide, and wherein the actuator drive for a linear movement of the mold slide in relation to the expansion slide supported on the expansion slide.

The mold slide is advantageously designed in such a manner that, on account of the mold slide, the radial position of an assigned actuating element for a longitudinal wire of the reinforcement is modifiable, in particular, during the production process of the reinforcement, by way of a transmission mechanism of the expansion device.

On account thereof, a modification of the geometry of the reinforcement, in particular of the reinforcement basket, advantageously a modification of the geometry of a cross section of the reinforcement, for example, from round to oval or vice versa, is implementable.

The expansion slide and/or the mold slide is configured, for example, for modifying a radial position of an assigned actuating element along a spoke of an expansion wheel for a longitudinal wire of the reinforcement. The expansion slide is advantageously moved by way of a first actuator drive, and the mold slide is advantageously moved by way of a second actuator drive.

An expansion wheel, for example, a main wheel and/or an advancing wheel, comprises, for example, between 4 and 48 spokes, between 8 and 40 spokes, between 12 and 36 spokes, between 16 and 32 spokes, or between 20 and 28 spokes, in particular, 24 spokes.

For example, the expansion slide and the mold slide along the transmission mechanism are configured for moving the same actuating element, in particular, by way of a same transmission mechanism. For example, the expansion slide and the mold slide are fixedly connected to the transmission mechanism, in particular, connected to the latter so as to be positionally fixed.

The mold slide is advantageously configured on the expansion slide, in particular on top of the expansion slide, so as to be movable relative to the expansion slide. A mold slide conjointly with the expansion slide, or conjointly with a transmission mechanism, respectively, preferably forms an actuating unit for an actuating element. For example, a plurality of actuating units are present on one device; in particular, one actuating unit and/or one mold slide are/is provided for each actuating element of each spoke of the expansion wheel.

The device, in particular the actuating unit, is preferably configured in such a manner that the expansion slide and the mold slide are switched successively in series.

The actuator drive is advantageously configured as a hydraulic cylinder, as a pneumatic cylinder, as an electric motor, and/or as a spindle drive. In particular, a movement of a mold slide by the actuator drive is decoupled from a movement of the expansion slide and/or of the mold slide that is driven by the expansion shaft.

A further advantageous, in particular substantial aspect of the device is that the device has a plurality of mold slides that are positionable in a mutually independent manner.

On account thereof, an arbitrary geometry of the cross section of the reinforcement is implementable. The device on account of the mold slides that are positionable in a mutually independent manner can thus configure the cross section of the reinforcement so as to be round, oval, rectangular, square, or polygonal.

The mold slides are preferably movable relative to the expansion slide in a mutually independent manner. For example, each mold slide has a dedicated actuator drive. It is also conceivable for all mold slides to be mutually coupled and/or for a single mold slide to be present. It is also advantageous for all mold slides to be movable relative to the expansion slide by way of a single actuator drive.

A mold slide is advantageously configured on the device in such a manner that by modifying a position of the mold slide relative to the expansion slide a radial position of the assigned actuating element along a spoke is modifiable relative to a radial position of a further actuating element along a further spoke, in particular, during the production process of the reinforcement.

A further advantageous, in particular substantial concept of the present invention is that the expansion device has a plurality of mold slides, wherein the transmission mechanism of the expansion device have a plurality of detent elements, wherein the expansion device comprises a detent element in the form of a shape imparter, wherein the shape imparter forms an entrainment element for a first detent member of a mold slide, and wherein one shape imparter is present on the transmission mechanism, in particular, for each mold slide.

On account thereof, a maximum difference between a radial position of one actuating element and a further radial position of another actuating element is predefinable. A difference between the radial positions herein is understood to be a difference between a spacing of one actuating element from a rotation axis of the expansion shaft and another spacing of a further actuating element from the rotation axis of the expansion shaft. On account thereof, a maximum spacing of a larger spacing from a rotation axis of the expansion wheel down to a smaller spacing from a rotation axis of the expansion wheel of a cross section of the reinforcement is predefined during production.

It is conceivable for the actuator drive to comprise the shape imparter. The shape imparter is advantageously configured so as to be positionally fixed on the transmission mechanism.

A further advantageous, in particular substantial proposal of the present invention, is that all transmission mechanisms are guided so as to be movable in relation to the expansion slide.

The expansion slide and/or the mold slide advantageously couple/couples to the transmission mechanism exclusively by way of a detent element. In particular, the expansion slide and/or the mold slide are/is positionable so as to be movable relative to the transmission mechanism. For example, a transmission mechanism is guided so as to be movable on the expansion slide and/or on a mold slide. On account thereof, the expansion slide and/or the mold slide couple to a transmission mechanism and/or to a detent element of a transmission mechanism exclusively in the event of an actuation procedure of the assigned actuating element, for example.

A further preferred, in particular substantial, concept of the present invention is that the expansion device has a mold slide, wherein the expansion slide is guided so as to be movable on the transmission mechanism, wherein a detent element which is capable of being jammed between the expansion slide and a mold slide is fixed to the transmission mechanism.

The detent element that is capable of being jammed is advantageously designed as a guide element. In particular, at least two guide elements are provided, wherein each guide element is in each case capable of being jammed between the expansion slide and a mold slide. On account thereof, the guide element forms an entrainment element for a first detent face of the expansion element and for a second detent member of the mold slide. The second detent member of the mold slide is preferably disposed so as to be opposite the first detent member.

For example, a detent element is present so as to be positionally fixed to the transmission mechanism. In particular, the expansion slide and a mold slide couple to the transmission mechanism by way of a detent element. Advantageously, a single mold slide by way of a single detent element couples to one or a plurality of transmission mechanism, preferably to a drive chain or a drive rod.

It is also conceivable for an actuator drive to comprise a guide element. For example, in each case a second cylinder chamber of the cylinder of the actuator drive is designed in such a manner that the cylinder, in particular the cylinder chamber, forms the guide element and/or the entrainment element.

It is also advantageous for the expansion device to have a detent element in the form of a path limiter, wherein the path limiter forms an entrainment element for a second detent face of the expansion slide, wherein the path limiter predefines a maximum spacing between a first detent member of the mold slide and the second detent face of the expansion slide.

The path limiter predefines, in particular, a maximum spacing between the first detent member of the mold slide on the shape imparter and the second detent face of the expansion slide. On account of this spacing, a maximum mutual radial positioning difference of the actuating element is predefined. The expansion device advantageously comprises a single path limiter. It is also conceivable for an actuator drive to have a path limiter.

The two detent faces of the expansion element are preferably present so as to be mutually opposite on the expansion element.

Alternatively, the actuator drive is configured as a double-action cylinder. The double-action cylinder is designed, for example, as a hydraulic cylinder or as a pneumatic cylinder. It is conceivable for the double-action cylinder to comprise the shape imparter. For example, a stroke length of a first cylinder chamber of the cylinder is for example different to each other designed, that by way of the stroke lengths of the cylinder, a maximum difference between a radial position of one actuating element and a further radial position of a further actuating element is capable of being predefined.

It is furthermore advantageous for the expansion slide and a mold slide to be driven by an expansion shaft of the device, in particular, in a mutually separate manner.

The expansion shaft can advantageously form the actuator drive. The expansion slide and the mold slide can be present on the expansion shaft in such a manner that the expansion shaft can move the mold slide and the expansion slide in a mutually separate manner.

It is furthermore proposed that a position of a detent element along the transmission mechanism is modifiable.

For example, a position of a shape imparter, of a path limiter, and/or of a guide element is modifiable in particular along a drive chain. A spacing between in each case one shape imparter and one guide element along the transmission mechanism is advantageously modifiable. A distance between in each case one guide element and one path limiter along the transmission mechanism is preferably constant and unmodifiable.

For example, a first spacing of a first shape imparter from a first guide element along a first drive chain is unequal to a second spacing of a second shape imparter from a second guide element along a second drive chain. On account thereof, changing the shape of the reinforcement basket, for example, from round to oval or vice versa, is implementable in the assembled state of the device on the machine. However, it is also conceivable that all spacings between the shape imparters and the guide elements are equal. On account thereof, a modification of the size of the shape of the reinforcement basket, for example, of the reinforcement basket diameter, is implementable.

A distance between the guide elements and a path limiter is advantageously identical. In particular, a first distance of the first guide element to a first path limiter along a first drive chain is equal to a second spacing of a second guide element from a second path limiter along a second drive chain. On account thereof, a maximum spacing of a radial position of a first actuating element from a radial position of a second actuating element is predefinable.

BRIEF DESCRIPTION OF THE DRAWINGS

An exemplary embodiment will be explained in more detail by means of the schematic drawings hereunder while stating further details and advantages.

DETAILED DESCRIPTION OF THE INVENTION

Figure 1:
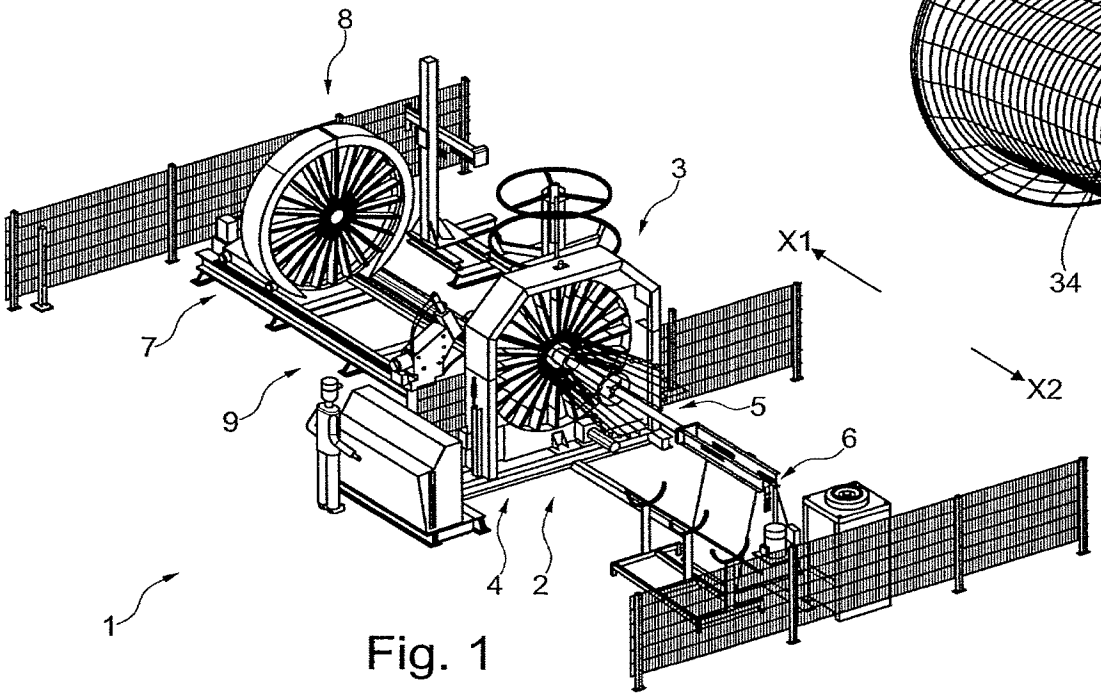
FIG. 1 shows a perspective view laterally from above onto a machine for producing reinforcements, having a device according to the present invention.

A machine 1 for producing a reinforcement basket 10 comprises a device 2 according to the present invention, which in the region of the main wheel 3 of the machine 1 is configured on the main wheel 3. The main wheel 3 is fastened to a main frame 4, in particular, fastened so as to be positionally fixed in relation to the main frame 4. The machine 1 furthermore comprises an expansion shaft 5, an expansion block 6, and an advancing carriage 7 having an advancing wheel 8, the advancing carriage 7 being mounted so as to be relocatable in a linear manner on guide rails 9 (FIG. 1).

Figure 2:
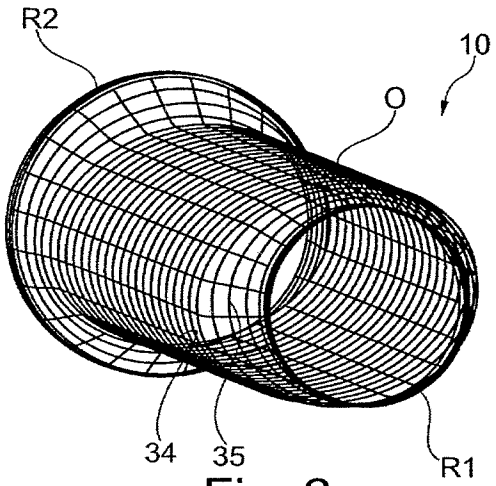
FIG. 2 shows a perspective view laterally from above onto the front of a reinforcement basket.
Figure 3:
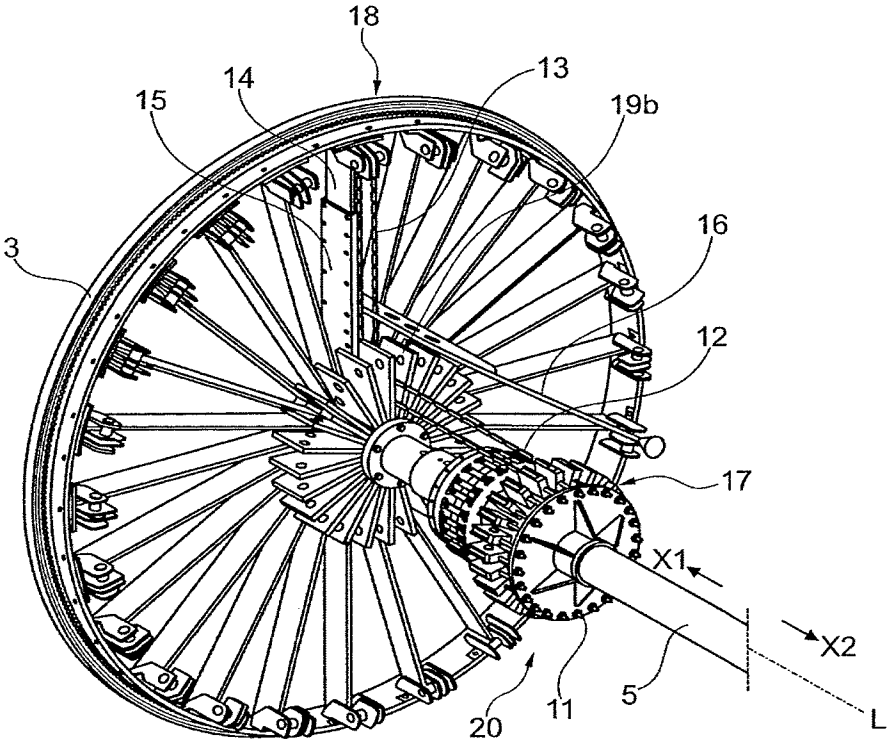
FIG. 3 shows a perspective view laterally from above onto the rear of the device as per FIG. 1.

A spoke 14 is present on the main wheel 3, an actuating element 15 being mounted on said spoke 14 so as to be displaceable along the latter in the radial direction, in a manner perpendicular to a longitudinal axis L of the expansion shaft 5. Furthermore, a wire guide tube 16 which is provided for guiding a longitudinal wire 34 of the reinforcement basket 10, in particular in a manner parallel with the longitudinal axis L, to the actuating element 15 is disposed on the actuating element 15 (FIG. 3). A welding device for welding the longitudinal wire 34 to a transverse wire 35 of the reinforcement basket 10 is disposed in the region of the actuating element 15 (welding device not illustrated, FIG. 2).

The device 2 comprises an expansion slide 11, a mold slide 12, and a transmission mechanism in the form of a chain 13. The chain 13 is configured as a continuous chain, for example, that is to say that the ends of the chain 13 are interconnected. The chain 13 is guided so as to be movable by way of chain deflections 17, 18, 19*a*, 19*b* and connects the actuating element 15 to an actuating unit 20 which is composed of the mold slide 12 and the expansion slide 11. The chain 13 is fixedly connected to the actuating element 15. For reasons of clarity, a single actuating unit 20 having a chain 13 and an assigned actuating element 15 is shown in FIG. 3.

Figure 4:
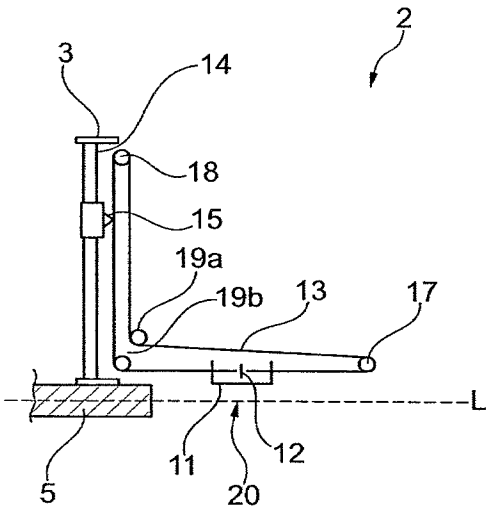
FIG. 4 shows a plan view in a simplified illustration onto a cross section of a device, the cross section being parallel with a longitudinal axis of an expansion shaft of a machine.

FIG. 4 shows the arrangement from FIG. 3 in a simplified illustration, wherein the view is a cross section through the expansion shaft 5 and the main wheel 3, the cross section being parallel with the longitudinal axis L of the expansion shaft 5.

FIGS. 5, 7, 9, and 11 show in each case two different cross sections through the device 2 in a simplified illustration, the cross sections being parallel with the expansion shaft 5. In each case three chains 13*a*, 13*b*, 13*c* are illustrated in each of the figures, the chains 13*a*, 13*b*, 13*c* comprising detent elements in the form of a shape imparter 27*a*, 27*b*, of a path limiter 26, and of guide elements 24*a*, 24*b*, 24*c*. For example, the shape imparters 27*a*, 27*b* have dissimilar shapes, for example, the shape imparters 27*a*, 27*b* are configured so as to be of dissimilar length along the longitudinal axis L of the expansion shaft 5. The shape imparters 27*a*, 27*b* can be mounted so as to be displaceable on the chains 13*a*, 13*b*. For example, it is also conceivable for the detent elements to be spaced apart in a positionally fixed manner along a chain 13*a*, 13*b*, 13*c*, and to be clamped to the chain 13*a*, 13*b*, 13*c*, for example.

Figure 6:
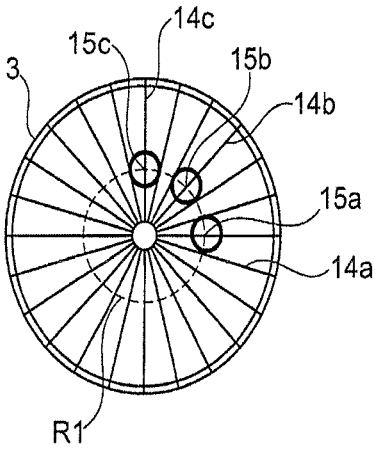
FIGS. 5 to 11 show a schematic illustration of a cross section through a main wheel of the machine in various functional positions, the cross section being parallel with the longitudinal axis of the device and perpendicular to the longitudinal axis of the device.
Figure 5:
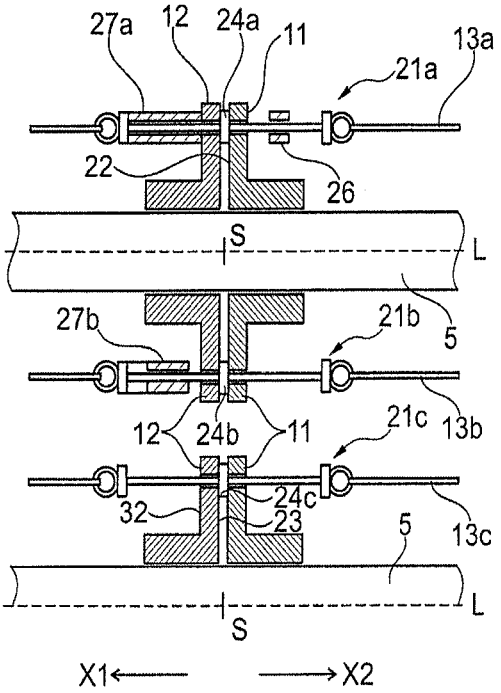
Figure 8:
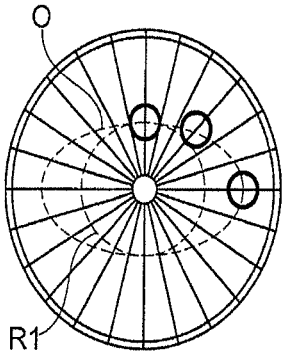
Figure 7:
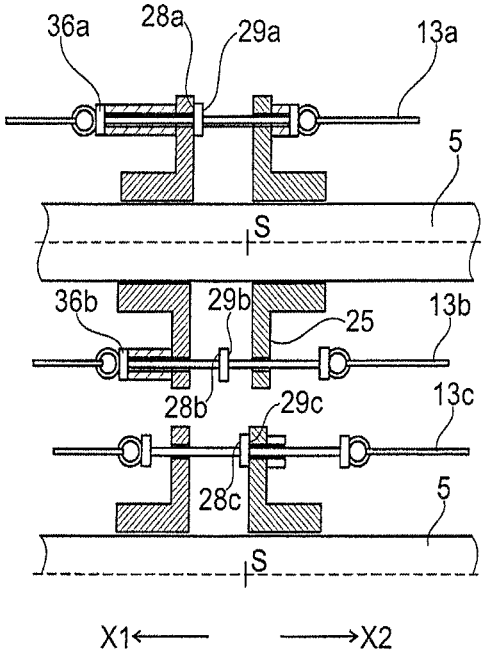
Figure 10:
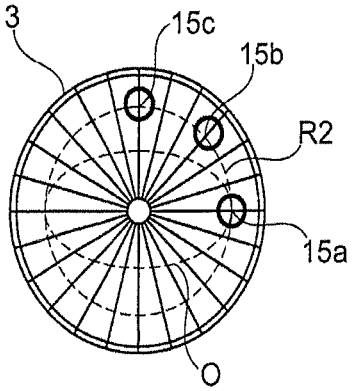

The detent elements, in particular, prior to a production of a reinforcement basket 10, are capable of being set to the respective geometry of the reinforcement basket 10. Moreover, each chain 13*a*, 13*b*, 13*c* is, in particular, fixedly coupled to in each case one actuating element 15*a*, 15*b*, and 15*c*, respectively (FIGS. 6, 8, 10).

The chain 13*a*, 13*b*, 13*c* has a rod-shaped portion 21*a*, 21*b*, 21*c*. The chain 13*a*, 13*b*, 13*c* on the rod-shaped portion 21*a*, 21*b*, 21*c* is mounted on the expansion slide 11 and on the mold slide 12 so as to be movable in a direction X1 or X2 that is parallel with the longitudinal axis L of the expansion shaft 5. A guide element 24*a*, 24*b*, 24*c* is attached to the rod-shaped portion 21*a*, 21*b*, 21*c* of the chains 13*a*, 13*b*, 13*c* so as to be positionally fixed, in particular, so as to be parallel with the longitudinal axis L of the expansion shaft 5, between a first detent face 22 of the expansion slide 11 and a first detent member 23 of the mold slide 12. The guide element 24*a*, 24*b*, 24*c* is configured, for example, as an entrainment element having entrainment faces 28*a*, 28*b*, 28*c*, 29*a*, 29*b*, 29*c* for the expansion slide 11 and the mold slide 12.

A second detent face 25 is present on a side opposite the first detent face 22 of the expansion slide 11. Moreover, a path limiter 26 is attached so as to be positionally fixed on the rod-shaped portion 21*a*, wherein the path limiter 26 is present on that side of the expansion slide 11 that faces the second detent face 25 such that the detent faces 22, 25 of the expansion slide 11 are configured between the path limiter 26 and the mold slide 12. The device 2 is advantageously configured in such a manner that a single chain 13*a* comprises one path limiter 26.

Moreover, shape imparters 27*a*, 27*b* are disposed so as to be positionally fixed on the rod-shaped portions 21*a*, 21*b*. The shape imparters 27*a*, 27*b* in terms of the shape thereof can be configured in dissimilar sizes, for example, in particular, the shape imparters 27*a*, 27*b* are fastened to the rod-shaped portions 21*a*, 21*b* in such a manner that entrainment faces 31*a*, 31*b* of the shape imparters 27*a*, 27*b* have dissimilar spacings from the entrainment faces 28*a*, 28*b* of the guide elements 24*a*, 24*b*. If the shape imparters 27*a*, 27*b* are present so as to be displaceable on the chains 13*a*, 13*b*, the shape imparters 13*a*, 13*b* can impact on an entrainment element 36*a*, 36*b* of the chains 13*a*, 13*b*, wherein the entrainment elements 36*a*, 36*b* are present on the chains 13*a*, 13*b* so as to be positionally fixed in the direction X1, X2.

The expansion slide 11 is mounted in such a manner that the expansion slide 11 by the expansion shaft 5 is drivable so as to be displaceable in a direction X1, or X2, respectively, that is parallel with the longitudinal axis L of the expansion shaft 5. The mold slide 12 is mounted on the expansion slide 11 so as to be movable in a direction X1, or X2, respectively, that is parallel with the longitudinal axis L of the expansion shaft 5. A position of the mold slide 12 relative to the expansion slide 11 is modifiable by way of an actuator drive 30 which is configured, for example, between the expansion slide 11 and the mold slide 12.

Actuating elements 15*a*, 15*b*, 15*c* on the main wheel 3 are schematically illustrated on spokes 14*a*, 14*b*, 14*c* in FIGS. 6, 8, 10.

The reinforcement basket for a reinforcement pipe is assembled from longitudinal wires 34 and transverse wires 35. For example, the reinforcement basket in the cross section perpendicular to a longitudinal axis can have three dissimilar main geometries. A first main geometry R1 is circular, for example, having a first radius, a second main geometry O is oval, and a third main geometry R2 is again a circular, having a second radius which is larger in relation to the first radius of the main geometry R1 (FIG. 2). The device 2 is configured for relocating actuating elements of the machine 1 in such a manner that the reinforcement basket 10 is producible as is illustrated in FIG. 2. To this end, the expansion slide 11 and the mold slide 12 are relocated on the expansion shaft 5, for example, in a manner parallel with the longitudinal axis L of the expansion shaft 5 as is illustrated in FIGS. 5, 7, 9, and 11.

Actuation procedures of the expansion slide 11 and of the mold slide 12, and thus of the actuating elements 15*a*, 15*b*, 15*c* (FIGS. 6, 8, 10) for producing the reinforcement basket 10 on the machine 1 will be described hereunder.

The mold slide 12 in an initial position (FIG. 5), optionally by way of the actuator drive 30, is moved up to the expansion slide 11 in such a manner that the mold slide 12 advantageously jams the guide elements 24*a*, 24*b*, 24*c* between the first detent member 23 of the mold slide 12 and the first detent face 22 of the expansion slide. The guide elements 24*a*, 24*b*, 24*c* in the initial position on the expansion shaft 5 all have an identical starting position S along a longitudinal axis L of the expansion shaft 5. Moreover, the chains 13*a*, 13*b*, 13*c* in the initial position couple to the actuating elements 15*a*, 15*b*, 15*c* in such a manner that the actuating elements 15*a*, 15*b*, 15*c* along the spokes 14*a*, 14*b*, 14*c* have the same spacing from the wheel axis, or have the same radius, respectively, (FIG. 6). A machine 1 in this initial position thus produces a reinforcement having this circular geometry R1.

If the geometry of the reinforcement is now to be modified, for example, from the circular geometry R1 to an oval geometry O, the spacing of the mold slide 12 from the expansion slide 11 is modified by way of the actuator drive 30. This means that the position of the expansion slide 11 relative to the starting position S is not modified along the longitudinal axis L of the expansion shaft 5. By contrast, the mold slide 12, for example, by the actuator drive 30, is urged away from the expansion slide 11 in the direction X1 that is parallel with the longitudinal axis L. Depending on the spacing from the shape imparters 27*a*, 27*b*, the mold slide 12 in this movement, by way of the second detent member 32 thereof that is configured opposite the first detent member 23, after a comparatively short or comparatively long distance contacts an entrainment face 31*a*, 32*a* of the shape imparter 27*a*, 27*b*. On account thereof, the mold slide 12 in the movement thereof in the direction X1 moves the chains 13*a*, 13*b*, 13*c* dissimilarly far. The chain 13*a* in the example (FIG. 7) is conjointly moved along the entire length of the movement of the mold slide 12 in the direction X1, since the mold slide 12 by way of the second detent member 32 bears on the entrainment face 31*a* already in the initial position. Accordingly, the actuating element 15*a* modifies the position thereof along the spoke 14*a* toward a larger radius. The chain 15*b* is moved only a short distance as compared to the chain 15*a*. Accordingly, the radius of the actuating element 15*b* is somewhat enlarged. The chain 15*c* is not moved at all, since the mold slide 12 by way of the second detent member 32 thereof does not meet any resistance, or contact any detent, respectively. Accordingly, the radius of the actuating element 15*c* is likewise not modified (FIG. 8). It would also be conceivable for the device 2 to be designed in a reversed order, such that the actuating elements 15*a*, 15*b* would be moved in the opposite direction and the radius of the actuating elements 15*a*, 15*b* would be reduced.

The mold slide 12 can be moved that far until the path limiter 26 by way of the detent thereof impacts against the second detent face 25 of the expansion slide 11. On account thereof, a maximum relocation path of the mold slide 12 relative to the expansion slide 11 is limited. On account thereof, a maximum difference between a radius of one actuating element and another actuating element is also predefined.

Figure 9:
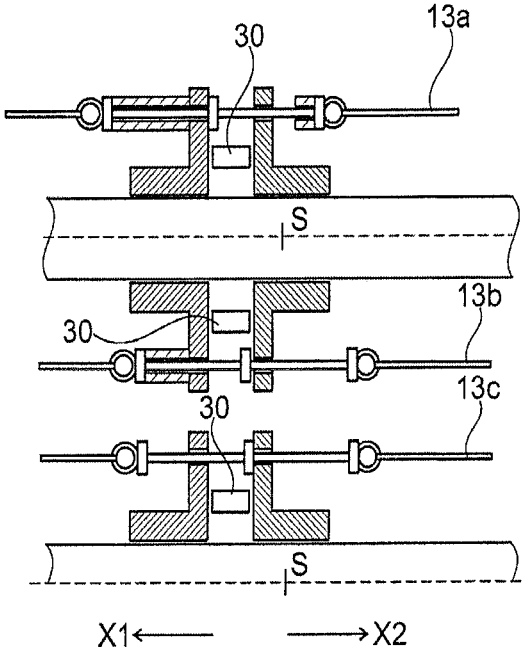
Figure 11:
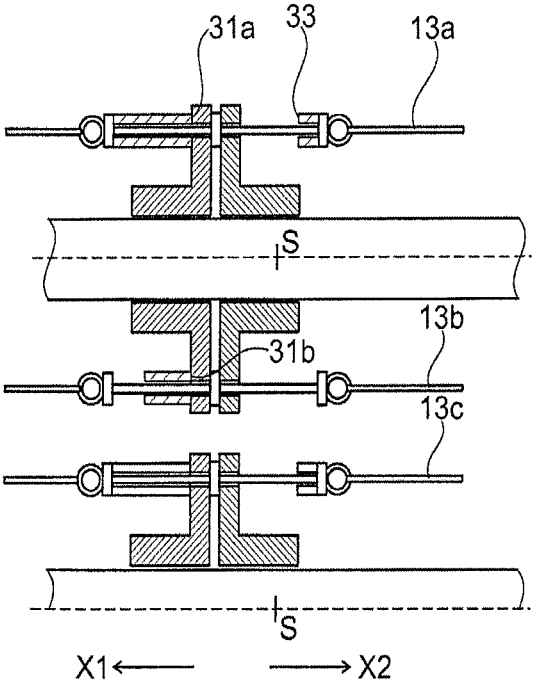

Should the geometry of the reinforcement 10 in the course of the production of the reinforcement 10 be modified to a cross section having a circular geometry R2 having a larger radius, the expansion slide 11, for example, driven by the expansion shaft 5, is moved parallel with the longitudinal axis L of the expansion shaft 5 in the direction X1 toward the mold slide 12 (FIGS. 9, 11). The mold slide 12 herein maintains the position thereof relative to the starting position S on the expansion shaft 5, since a force of the shape imparters 27 that acts on the form slide 12, for example, is higher than a force which in the movement of the expansion slide 11 acts by way of the actuator drive 30 in the direction X1 on the mold slide 12, or on the shape imparters 27*a*, 27*b*, for example. The spacing between the expansion slide 11 and the mold slide 12 is thus reduced. In the movement of the expansion slide 11 in the direction X1 the expansion slide 11 by way of the first detent face 22 thereof, in a manner corresponding to the preceding movements of the chains 13*a*, 13*bs*, 13*c*. sooner or later contacts the entrainment faces 29*a*, 29*b*, 29*c* of the guide elements 24*a*, 24*b*, 24*c* of the chains 13*a*, 13*b*, 13*c*. The expansion slide 11 in the example (FIG. 7) by way of the first detent face 22 thereof already bears on the entrainment face 29*c* of the guide element 24*c* and thus moves the chain 13*c* along the entire displacement path of the expansion slide 11 in the direction X1. By contrast, the expansion slide 11 by way of the first detent face 22 thereof reaches the entrainment face 19*a* of the guide element 24*a* only at the end of the movement of the expansion slide 11, the chain 13*a* in this case thus remaining unmoved (FIGS. 9, 11). Accordingly, the actuating element 15*a* along the spoke 14*a* in this movement of the expansion slide 11 remains at the position of said actuating element 15*a* on the spoke 14*a*, and the two other actuating elements 15*b*, 15*c* are displaced to a position having the same radius as the actuating element 15*a* on the spokes 14*b*, 14*c*. On account thereof the circular geometry R2 having a larger radius is implemented (FIG. 10).

Should the circular geometry R1 having a small radius be returned to again, the spacing between the expansion slide 11 and the mold slide 12 is retained, for example, by the actuator drive 30, such that the mold slide 12 maintains a fixed identical position relative to the expansion slide 11. The expansion slide 11, for example, driven by the expansion shaft 5, is subsequently driven back in the direction X2 that is parallel with the longitudinal axis L of the expansion shaft 5, such that the guide elements 24*a*, 24*b*, 24*c* are again located level with the starting position S and the actuating elements are thus likewise again located in the initial position thereof on the spokes 14*a*, 14*b*, 14*c*.

LIST OF REFERENCE SIGNS

1 Machine
2 Device
3 Main wheel
4 Main frame
5 Expansion shaft
6 Expansion block
7 Advancing carriage
8 Advancing wheel
9 Guide rails
10 Reinforcement basket
11 Expansion slide
12 Mold slide
13, 13*a* to 13*c* Chain
14, 14*a* to 14*c* Spoke
15, 15*a* to 15*c* Actuating element
16 Wire guide tube
17 Chain deflection
18 Chain deflection
19*a*, 19*b* Chain deflection
20 Actuator
21*a* to 21*c* Portion
22 Detent member
23 Detent face
24*a* to 24*c* Guide element
25 Detent face
26 Path limiter
27*a*, 27*b* Shape imparter
28*a*, 28*b* Entrainment face
29*a*, 29*b* Entrainment face
30 Actuator drive
31*a*, 31*b* Entrainment face
32 Detent member
33 Detent
34 Longitudinal wire
35 Transverse wire
36*a*, 36*b* Entrainment element

The invention claimed is:

1. A device for producing a reinforcement comprising an expansion device which has a single expansion slide, wherein the expansion slide is configured for modifying a radial position of an actuating element for a longitudinal wire of the reinforcement by way of a transmission mechanism of the expansion device, wherein the expansion device has a mold slide, wherein an actuator drive is provided for moving the mold slide, and wherein the actuator drive for a linear movement of the mold slide in relation to the expansion slide is supported on the expansion slide.

2. The device as claimed in claim 1, wherein the device has a plurality of mold slides that are positionable in a mutually independent manner.

3. The device as claimed in claim 1, wherein the expansion device has a plurality of mold slides, wherein the transmission mechanism of the expansion device has a plurality of detent elements, wherein the expansion device comprises one detent element of the plurality of detent elements, in the form of a shape imparter, wherein the shape imparter forms an entrainment element for a first detent member of one mold slide of the plurality of mold slides, wherein for each mold slide one shape imparter is present on the transmission mechanism.

4. The device as claimed in claim 3, wherein all transmission mechanisms are guided so as to be movable in relation to the expansion slide.

5. The device as claimed in claim 1, wherein the expansion slide is guided so as to be movable on the transmission mechanism, wherein a detent element which is capable of being jammed between the expansion slide and athe mold slide is fixed to the transmission mechanism.

6. The device as claimed in claim 1, wherein the expansion device has a detent element in the form of a path limiter, wherein the path limiter forms an entrainment element for a second detent face of the expansion slide, wherein the path limiter predefines a maximum spacing between a first and/or a second detent member of the mold slide and the second detent face of the expansion slide.

7. The device as claimed in claim 1, wherein the actuator drive is configured as a double-action cylinder.

8. The device as claimed in claim 1, wherein the expansion slide and the mold slide are driven by an expansion shaft of the device so as to be driven in a mutually separate manner.

9. The device as claimed in claim 1, wherein a position of a detent element along the transmission mechanism is modifiable.

10. A machine for producing a reinforcement having a device as claimed in claim 1.

11. A device for producing a reinforcement comprising an expansion device which has a single expansion slide, wherein the expansion slide is configured for modifying a radial position of an actuating element for a longitudinal wire of the reinforcement by way of a transmission mechanism of the expansion device, wherein the expansion device has a mold slide, wherein the expansion slide is guided so as to be movable on the transmission mechanism, wherein a detent element, which is capable of being jammed between the expansion slide and the mold slide, is fixed to the transmission mechanism.

12. The device as claimed in claim 11, wherein the detent element has the form of a path limiter, wherein the path limiter forms an entrainment element for a detent face of the expansion slide, and predefines a maximum spacing between one of a first detent member a second detent member of the mold slide and a detent face of the expansion slide.

13. The device as claimed in claim 11, wherein the actuator drive is configured as a double-action cylinder.

14. The device as claimed in claim 11, wherein the expansion slide and t the mold slide are driven by an expansion shaft of the device so as to be driven in a mutually separate manner.

15. The device as claimed in claim 11, wherein a position of the detent element along the transmission mechanism is modifiable.

16. A machine for producing a reinforcement having a device as claimed in claim 11.

* * * * *